US006680733B2

(12) United States Patent
Woo et al.

(10) Patent No.: US 6,680,733 B2
(45) Date of Patent: Jan. 20, 2004

(54) LIQUID CRYSTAL DISPLAY DEVICE WITH GAMMA VOLTAGE CONTROLLER

(75) Inventors: You Tack Woo, Kyoungsangbuk-do (KR); Sang Gyu Kim, Kyoungsangbuk-do (KR); Youn Su Kang, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 231 days.

(21) Appl. No.: 10/012,396

(22) Filed: Dec. 12, 2001

(65) Prior Publication Data

US 2002/0101416 A1 Aug. 1, 2002

(30) Foreign Application Priority Data

Dec. 15, 2000 (KR) ..... P2000-76848

(51) Int. Cl.[7] ..... G09G 5/00
(52) U.S. Cl. ..... 345/212; 341/144; 348/674
(58) Field of Search ..... 345/214, 212, 345/204, 89, 95; 341/144, 150; 348/674, 675, 677, 694, 696

(56) References Cited

U.S. PATENT DOCUMENTS 5,969,657 A * 10/1999 Dempsey et al. ..... 341/145
6,424,281 B1 * 7/2002 Liaw et al. ..... 341/144
6,445,322 B2 * 9/2002 Watson ..... 341/144
2002/0063666 A1 * 5/2002 Kang et al. ..... 345/87
2003/0122757 A1 * 7/2003 Bu ..... 345/87
2003/0142084 A1 * 7/2003 Chang et al. ..... 345/204

* cited by examiner

*Primary Examiner*—Amare Mengistu
(74) *Attorney, Agent, or Firm*—Morgan Lewis & Bockius LLP

(57) ABSTRACT

A liquid crystal display device include a gamma a voltage controller. The gamma voltage controller includes a voltage-divider network of resistive elements and is part of a gamma voltage circuit, which also includes a programmable digital-to-analog converter. The output voltage signals from the programmable digital-to-analog converter are input to the gamma voltage controller for requisite voltage division. The voltage difference between any two voltage signals output from the gamma voltage controller (i.e., the gamma reference voltage signals) can be finely aligned by setting appropriate values for different resistive elements in the gamma voltage controller. This allows generation of gamma reference voltage signals whose voltages can be precisely controlled according to the T-V characteristics of a liquid crystal display panel in the liquid crystal display device.

8 Claims, 10 Drawing Sheets

FIG.7

VAA = 10.42

| GMA | Setting Resistance | | Code 32 | Variable Range | | DAC | V / 1bit |
|---|---|---|---|---|---|---|---|
| | VAA R2 | Ground R3 | Voltage | Min | Max | R1 | |
| GMA1 | 910 | 18K | 9.49 | 9.156 | 9.78 | 10K | 0.01 |
| GMA2 | 2K | 18K | 8.22 | 7.17 | 9.25 | 5.6K | 0.033 |
| GMA3 | 3.3K | 18K | 7.76 | 6.68 | 8.81 | 6.8K | 0.033 |
| GMA4 | 4.7K | 18K | 7.28 | 6.12 | 8.42 | 10K | 0.036 |
| GMA5 | 6.8K | 18K | 6.82 | 5.77 | 7.85 | 15K | 0.033 |
| GMA6 | 8.2K | 18K | 6.56 | 5.3 | 7.6 | 15K | 0.036 |
| GMA7 | 9.1K | 15K | 5.98 | 4.81 | 7.12 | 15K | 0.036 |
| GMA8 | 10K | 15K | 5.84 | 4.75 | 6.91 | 18K | 0.034 |
| GMA9 | 12K | 6.8K | 4.02 | 2.86 | 5.14 | 10K | 0.036 |
| GMA10 | 12K | 6.2K | 3.86 | 2.83 | 5.08 | 10K | 0.035 |
| GMA11 | 12K | 5.6K | 3.64 | 2.6 | 4.66 | 12K | 0.032 |
| GMA12 | 12K | 4.3K | 3.14 | 2.24 | 4.02 | 12K | 0.028 |
| GMA13 | 15K | 3.9K | 2.67 | 1.79 | 3.54 | 12K | 0.027 |
| GMA14 | 15K | 2.2K | 2.07 | 1.12 | 3 | 6.8K | 0.029 |
| GMA15 | 15K | 1.6K | 1.65 | 0.89 | 2.39 | 6.8K | 0.023 |
| GMA16 | 15K | 240 | 0.33 | 0.18 | 0.48 | 6.8K | 0.005 |

LIQUID CRYSTAL DISPLAY DEVICE WITH GAMMA VOLTAGE CONTROLLER

The present invention claims the benefit of Korean Patent Application No. P2000-76848 filed in Korea on Dec. 15, 2000, which is hereby incorporated by reference.

BACKGROUND OF THE INVENTION

1. Field of the Invention

This invention is generally related to a liquid crystal display (LCD), and more particularly to a liquid crystal display with a gamma voltage controller for finely aligning the output of a programmable digital-to-analog converter by precisely controlling the voltage difference between each level of the output.

2. Discussion of the Related Art

A liquid crystal display (LCD) with active matrix driving system utilizes thin film transistors (TFT) as switching elements to display natural-like moving pictures. Currently available LCD devices consume less power, emit significantly less harmful electromagnetic waves, save more work space due to their slimness and light weight, and bring more convenience to work environment than conventional cathode ray tube (CRT) devices. Therefore, as a display device, the LCD device replaces the CRT device in various applications, such as, for example, computer monitors, television displays, etc. Recently, with regard to video media, the conventional analog video signal transmission method has being changed to a digital video signal transmission method with which the compression of the information is easier. The digital signal transmission provides the audience with a high resolution picture. Thus, an LCD, which is a kind of a display device, must be capable of being driven by digital video signals instead of the conventional analog video signals.

FIG. 1 illustrates a block diagram of a related art active matrix LCD device. Referring to FIG. 1, the architecture of a related art LCD device includes a column driver 3 that supplies the video data received from an outside video card 1 to a liquid crystal panel 6; a gamma voltage circuit 4 that supplies a reference voltage to the column driver 3; a low driver 5 that supplies a scanning signal for controlling the switching action of the thin film transistors (TFT) on the liquid crystal panel 6; and a controller 2 that controls the column driver 3 and the low driver 5.

Generally, the liquid crystal panel 6 with the resolution of XGA (1024×768 pixels) has 1024×3(RGB)=3072 source lines. Accordingly, in the LCD with the resolution of XGA, eight (8) column drivers 3 with each column driver having an output terminal of 384 channels are utilized (384×8=3072), and four (4) low drivers 5 with each having an output terminal of 200 channels (200×4=800≈768) are utilized.

The video data received from the digital video card 1 (which may be built in the main body of, for example, a computer) is supplied to the column driver 3 through the controller 2. Alternatively, an analog video signal from a computer may be sent to the LCD after being converted to digital video data through an interface module (not shown) built in the LCD monitor itself.

FIG. 2 is a block diagram that shows circuit details for a column driver 3 shown in FIG. 1. As shown in FIG. 2, first a data latch 41 latches the video data (10, 11, 12) input received from the outside video card 1 through the controller 2. The data latch 41 latches the even and odd numbered video data being inputted by the controller 2 for the LCD panel 6. A shift register 40 is synchronized with an external clock signal CLK to sequentially generate a latch enable signal for storing the video data into a line latch 42. The line latch 42 sequentially stores the video data in synchronization with the latch enable signal. The line latch 42 includes a first and a second registers (not shown), each of which has the size of at least one line (here, eight bits). Here, the number of 8-bit source lines connected to one column driver is 384. The line latch 42 moves one line portion of the video data from the first register into the second register soon after that line portion of the video data is stored into the first register. The line latch 42 continues sequential storage of subsequent lines of video data into the first and the second registers.

A plurality of reference voltage signals are applied from the gamma voltage circuit 4 (FIG. 1) to a digital-to-analog converter 43 (FIG. 2), which then selects at least one or two reference voltage signals from the plurality of reference voltage signals in correspondence with each video data being supplied from the second register of the line latch 42. The digital-to-analog converter 43 also divides each reference voltage signal and outputs the divided reference voltage signal (corresponding to the video data) through an output buffer 44 to each of the source lines as an analog video signal.

The digital-to-analog converter 43, described herein as an example, has a resistance network distributing the selected reference voltage signal to inner gray level voltages in correspondence with the video data. The reference voltage signal can be controlled externally and is referred to as a tap point voltage. The inner gray level voltage between each tap point is automatically determined by the resistance network inside the digital-to-analog converter 43. Generally, LCD developers can set the gamma tap voltage, the transmission rate of which is in accordance with the T-V (transmittance-voltage) curve of the LCD panel 6, on the basis of the information for the driving circuit specification for the resistance network. FIG. 3 is a graph showing a predetermined relationship of a set of gamma tap voltages GMA1–GMA16 and the transmittance-voltage (T-V) characteristics curve of an LCD panel (e.g., the LCD panel 6). The setting of the gamma tap voltages is referred to as a Gamma Tuning. It is noted that the L00 (black) voltage and the L63 (white) voltage should be set carefully because those voltages decide a contrast ratio for the LCD panel 6.

FIG. 4 is a block diagram illustration of a related art gamma voltage circuit 4 of FIG. 1 that utilizes a conventional programmable digital-to-analog converter (DAC). The gamma voltage circuit 4 of related art utilizes as it is (i.e., without any further processing) the gamma voltages being output as reference voltage signals from the programmable DAC. In the case of a programmable digital-to-analog gamma voltage circuit 4 that can be controlled by a 6 bit control signal, a maximum of 64 ($2^6$=64) reference voltage signals can be generated. Normally, sixteen (16) out of these sixty-four (64) reference voltage signals (denoted as GMA1–GMA16) are selected as outputs. Thus, if the VAA voltage is 10V and the programmable DAC is 6-bit, then the controllable voltage step is of 10/64=0.156V. In other words, the programmable digital-to-analog gamma voltage circuit 4 outputs 64 reference voltage signals having a uniform gap of 0.156V. Because the related art programmable digital-to-analog gamma voltage circuit 4 generates the reference voltage signals with a fixed uniform gap, the precise control of the gamma voltages according to the characteristics of the LCD panel 6 becomes impossible.

SUMMARY OF THE INVENTION

Accordingly, the present invention is directed to a liquid crystal display device with a gamma voltage controller that substantially obviates one or more of the problems due to limitations and disadvantages of the related art.

An object of the present invention is to provide a liquid crystal display device with a gamma voltage controller that is capable of finely aligning the output of a programmable digital-to-analog converter in a gamma voltage circuit by precisely controlling the voltage difference between each level of the output.

To achieve the objects of the present invention, a gamma voltage circuit for a liquid crystal display according to one embodiment of the present invention includes a programmable digital-to-analog converter (DAC) having a predetermined number of first set of outputs, wherein the programmable DAC is configured to output a first plurality of analog reference voltage signals in response to a corresponding plurality of digital control signals input thereto, wherein each of the first plurality of analog reference voltage signals appears on a corresponding one of the first set of outputs; and a gamma voltage controller connected to the first set of outputs to generate a second plurality of analog reference voltage signals by dividing the first plurality of analog reference voltage signals, wherein the gamma voltage controller includes a plurality of voltage divider networks with a second set of outputs, wherein each voltage divider network in the plurality of voltage divider networks has an input and one of the second set of outputs, and wherein each such input is connected to a corresponding one of the first set of outputs and each of the second set of outputs is connected to a column driver circuit for the liquid crystal display.

In one embodiment, each voltage divider network in the gamma voltage controller includes three resistors connected in a predetermined series-parallel configuration to obtain desired voltage division. The resistance of each of the three resistors can be independently adjusted to achieve a non-uniform voltage gap between any two gamma reference voltage signals output from the gamma voltage controller.

Thus, the voltage difference or gap between any two voltage signals output from the gamma voltage controller (i.e., the gamma reference voltage signals) can be finely aligned by setting appropriate values for different resistive elements in the gamma voltage controller. This allows generation of gamma reference voltage signals whose voltages can be precisely controlled according to the T-V characteristics of a liquid crystal display panel in the liquid crystal display device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principles of the invention. In the drawings:

FIG. 7 is a chart showing a voltage variable extent and a voltage difference by steps for the embodiment of the gamma voltage circuit shown in FIGS. 6A–6D.

DETAILED DESCRIPTION OF PREFERRED EMBODIMENTS

Figure 1:
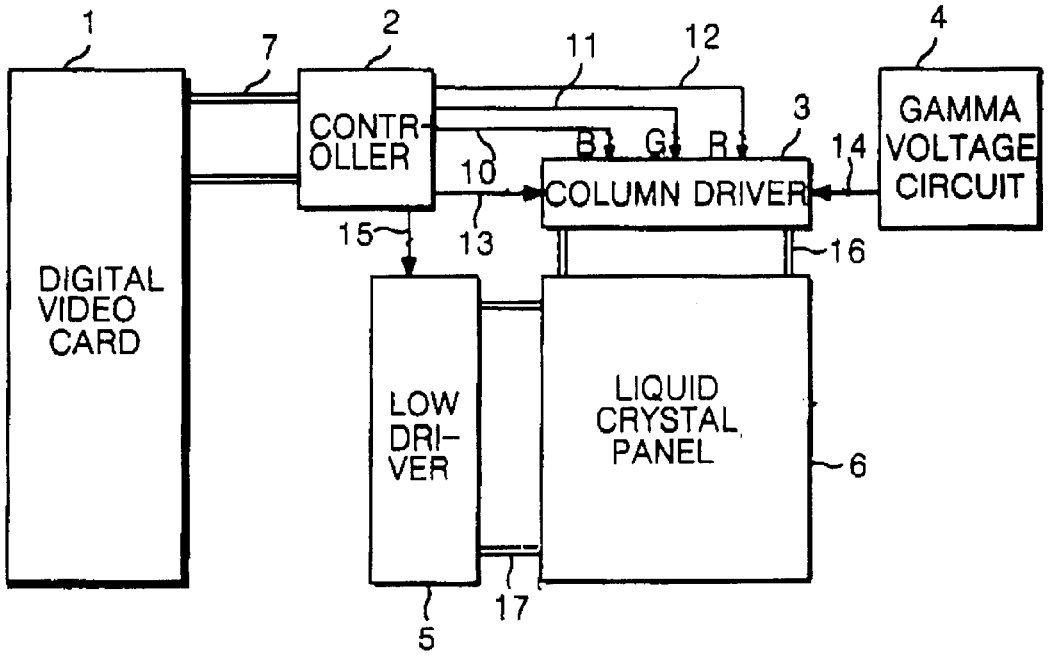
FIG.1 CONVENTIONAL ART
FIG. 1 illustrates a block diagram of a related art active matrix liquid crystal display device.
Figure 2:
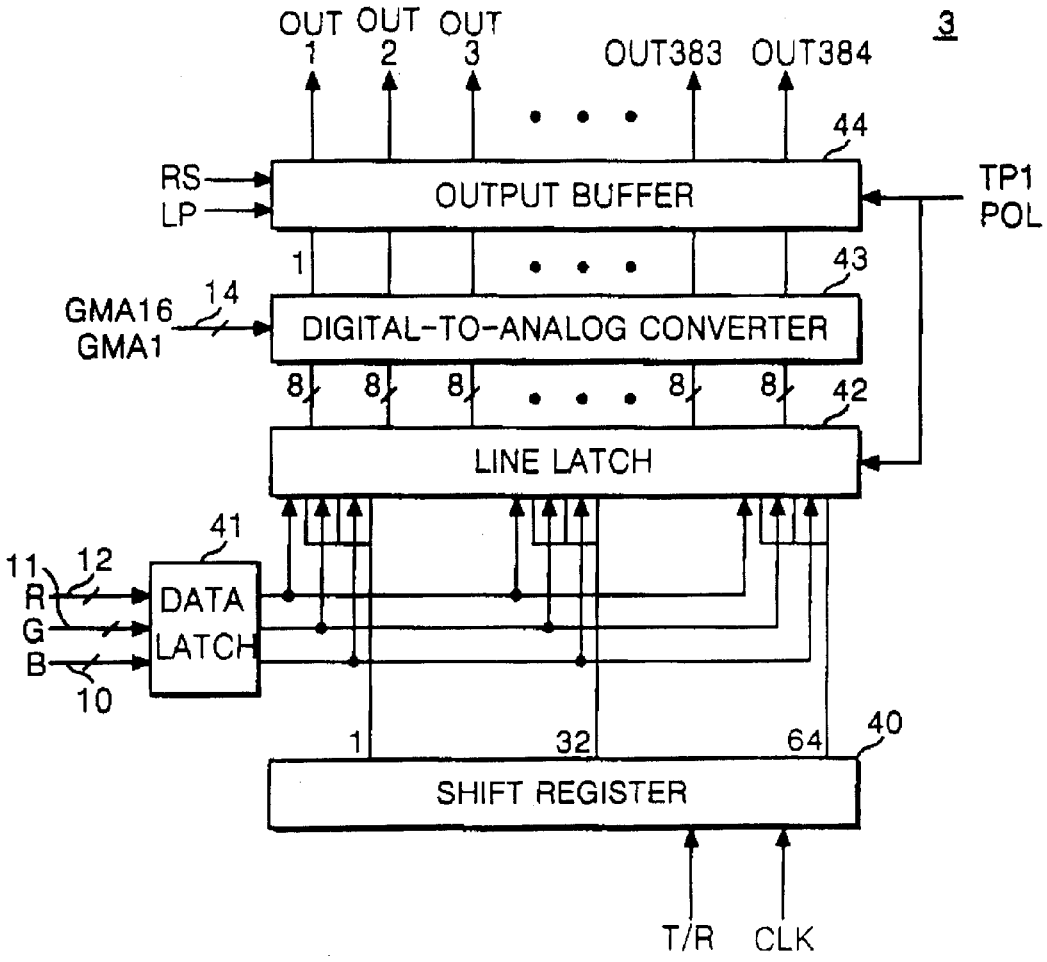
FIG.2 CONVENTIONAL ART
FIG. 2 is a block diagram that shows circuit details for a column driver shown in FIG. 1.
Figure 3:
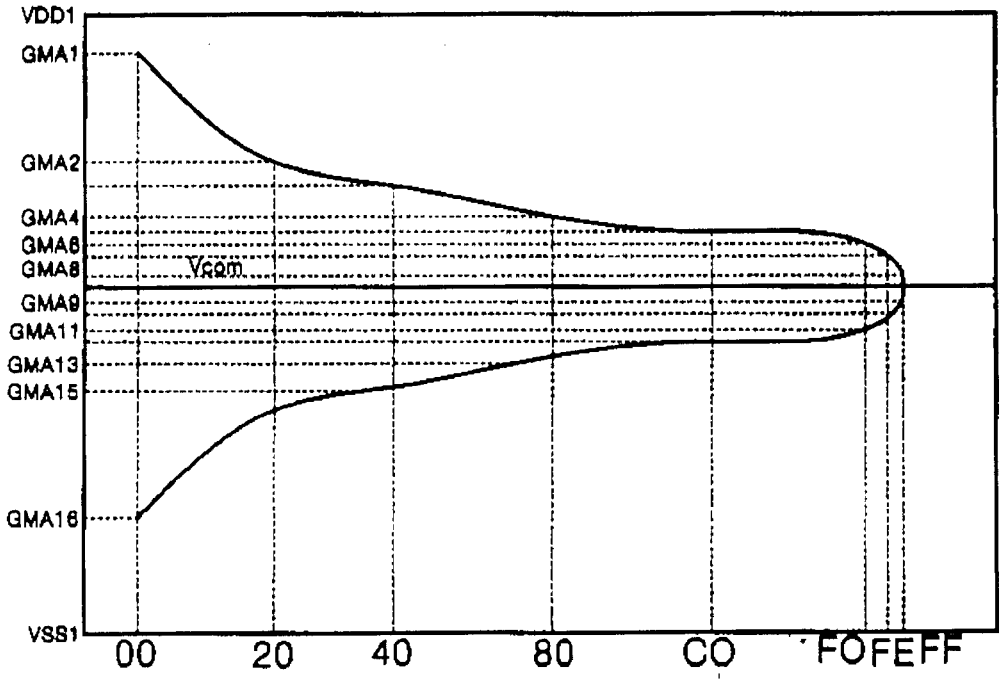
FIG. 3 is a graph showing a predetermined relationship of a set of gamma tap voltages and the transmittance-voltage characteristics curve of an LCD panel.
Figure 4:
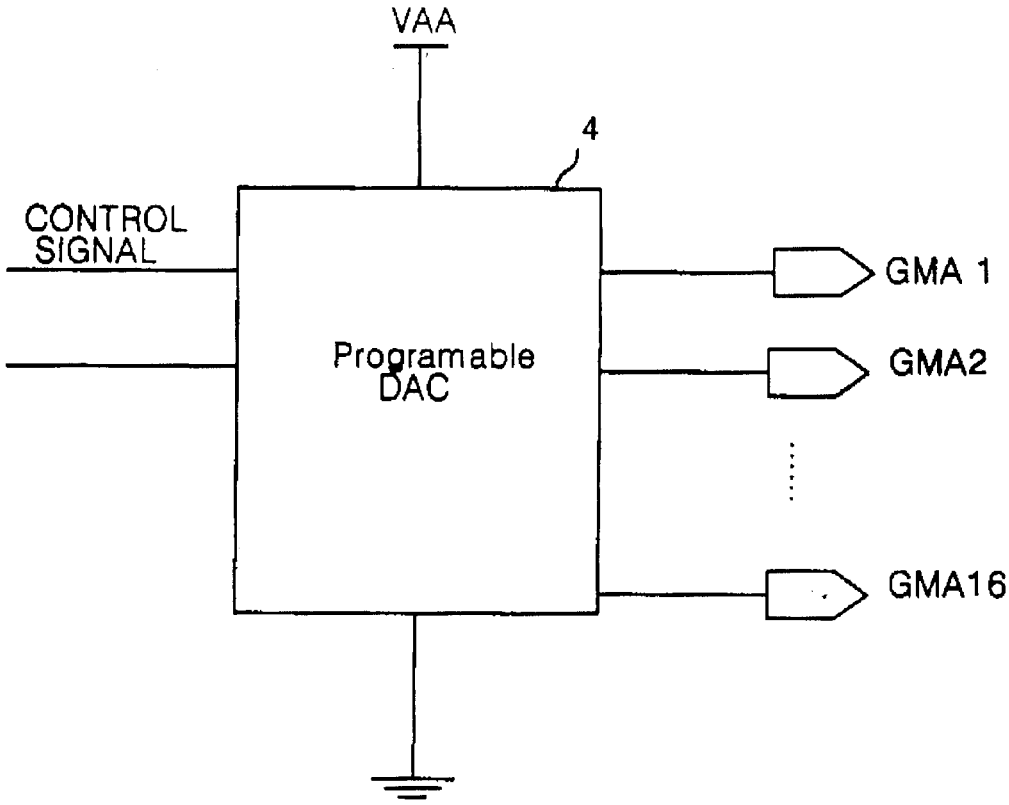
FIG. 4 is a block diagram illustration of a related art gamma voltage circuit of FIG. 1 that utilizes a conventional programmable digital-to-analog converter.
Figure 5:
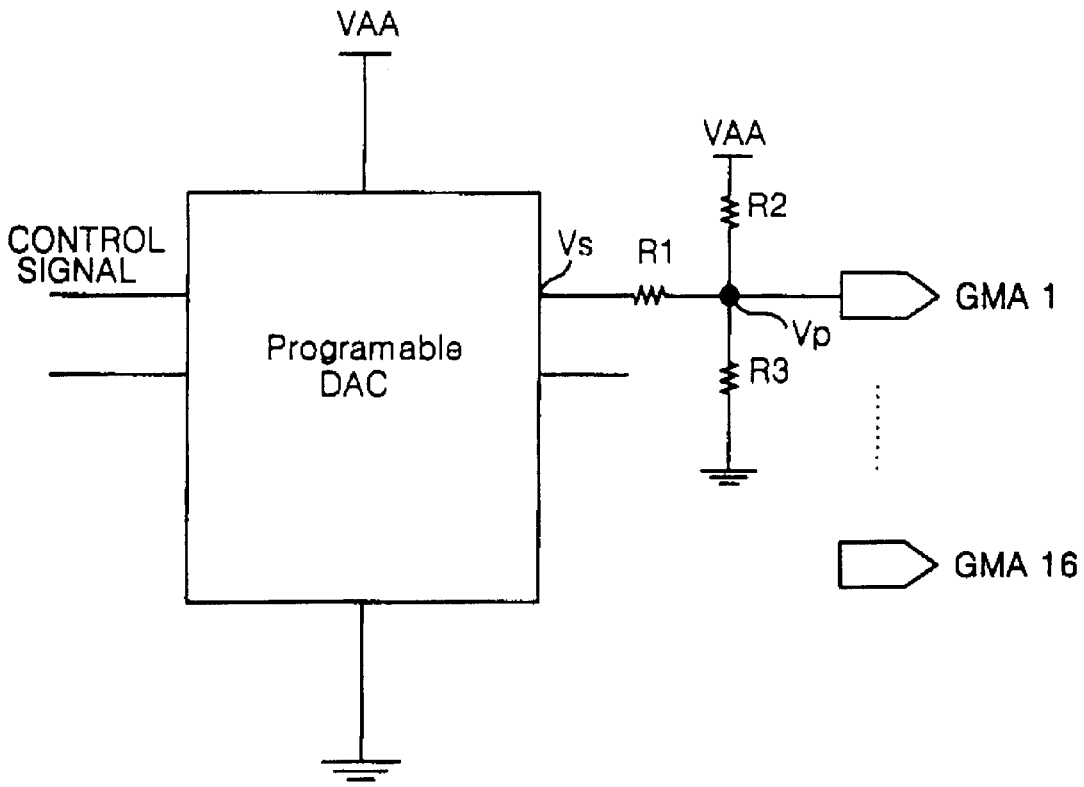
FIG. 5 is a block diagram showing an exemplary gamma voltage circuit according to the present invention.

Reference will now be made in detail to the preferred embodiments of the present invention, examples of which are illustrated in the accompanying FIGS. 5–7. Referring now to FIG. 5, a gamma voltage circuit according to one embodiment of the present invention includes a programmable digital-to-analog converter (DAC) 61, 63 (shown in FIGS. 6A and 6B respectively) and a gamma voltage controller connected at each output of the DAC. Each gamma voltage controller according to one embodiment of the present invention includes a network of resistive elements. For example, in the embodiment illustrated in FIG. 5, each gamma voltage controller includes a first resistance (R1) serially connected to a corresponding output line of the programmable DAC; and a second (R2) and a third (R3) resistances, each of which is connected in parallel to the first resistance and has a certain voltage (VAA) supplied to for generating the divided reference voltage for the column driver circuit 3 (FIG. 1). The extent of voltage step variations and the difference between each step of the divided reference voltage may be determined according to the resistance values for resistors R1, R2 and R3. The voltage values that become gamma reference voltages can be obtained through the following formula.

$$\begin{aligned} V_p &= V_{AA}[(R_1R_3/R_1+R_3)/\{R_2+R_1R_3/(R_1+R_3)\}] + \\ &\quad V_s[(R_2R_3/R_2+R_3)/\{R_1+R_2R_3/(R_2+R_3)\}] \\ &= V_{AA}[1/\{1+\{R_2(R_1+R_3)/R_1R_3\}] + \\ &\quad V_s[1/\{1+R_1(R_2+R_3)/R_2R_3\}] \end{aligned}$$

In the formula given above, Vp is the voltage appearing at the junction of the resistances R1, R2, R3 before being inputted as the gamma voltage source; Vs is the voltage appearing at the output of the programmable DAC; R1 is the resistance serially connected at each DAC output terminal; R2 is the resistance connected to VAA; and R3 is the resistance connected to the common voltage/ground. In the resistive network shown in FIG. 5, voltage Vp is computed as a sum of appropriate fractions of voltages VAA and Vs as given by the above formula. For example, in the above formula, the value of voltage VAA is multiplied by the value of the parallel combination of resistances R1 and R3 in series with resistance R2; whereas the value of Vs is multiplied by the value of the parallel combination of resistances R2 and R3 in series with resistance R1.

As can be seen from the foregoing formula, the gamma voltage source (i.e., output voltages on lines GMA1–GMA16) can be changed according to the values of R1, R2 and R3, and the difference between each voltage can be changed according to the change in the resistance values of the resistors R1, R2 and R3. In other words, contrary to the related art gamma voltage circuits, the gamma voltage circuit according to the present invention does not have the limitation that the gap (or "step") between each gamma reference voltage be uniform. Thus, a gamma voltage source that is capable of precisely controlling the voltage difference between each level of its output voltages by only using resistive elements (such as, for example, the resistances R1, R2 and R3 in FIG. 5) can also be provided according to the present invention.

Figure 6A:
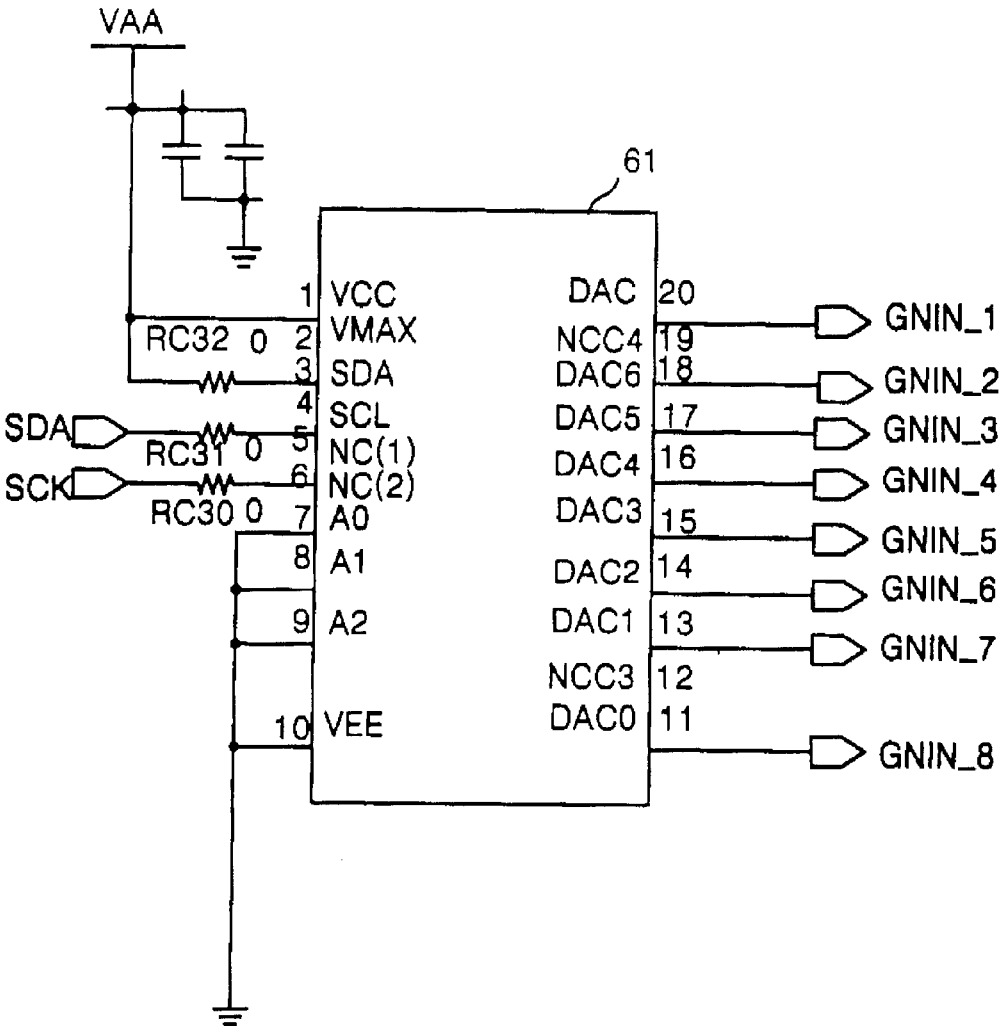
FIGS. 6A to 6D are exemplary circuit diagrams illustrating constructional details for two gamma voltage circuits with gamma voltage controllers according to one embodiment of the present invention.
Figure 6B:
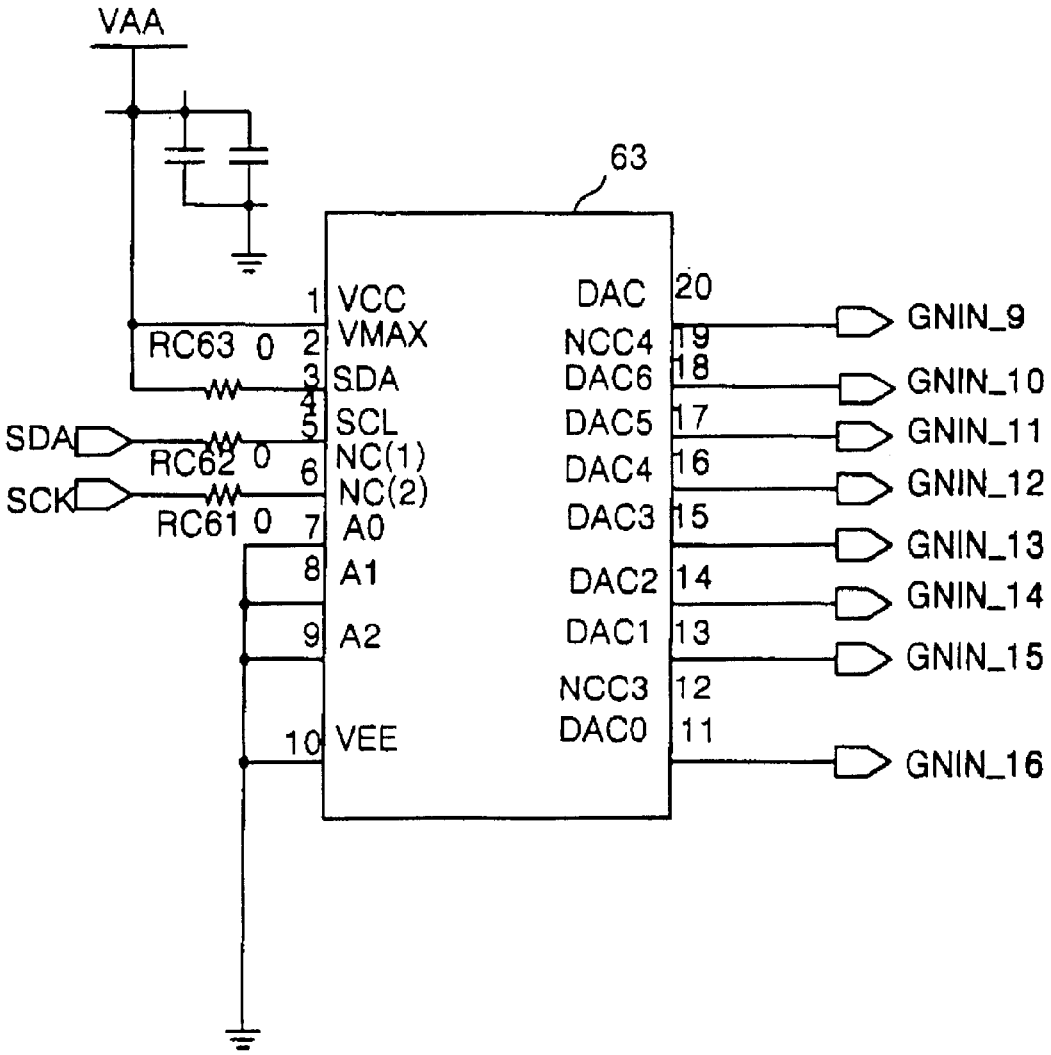
Figure 6C:
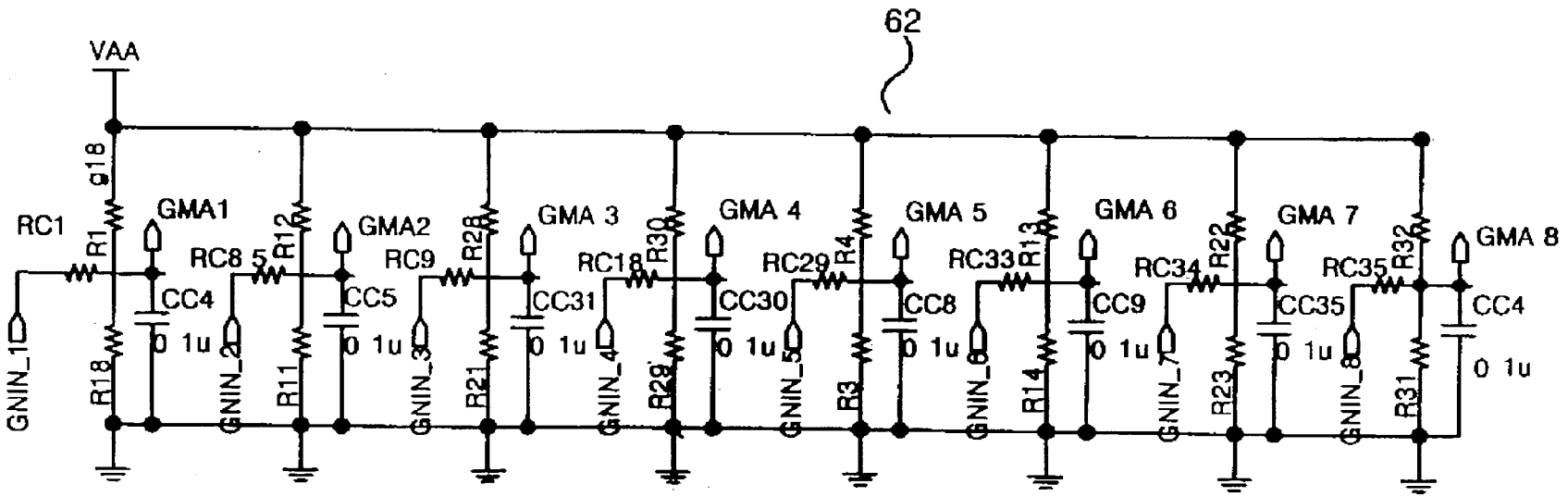
Figure 6D:
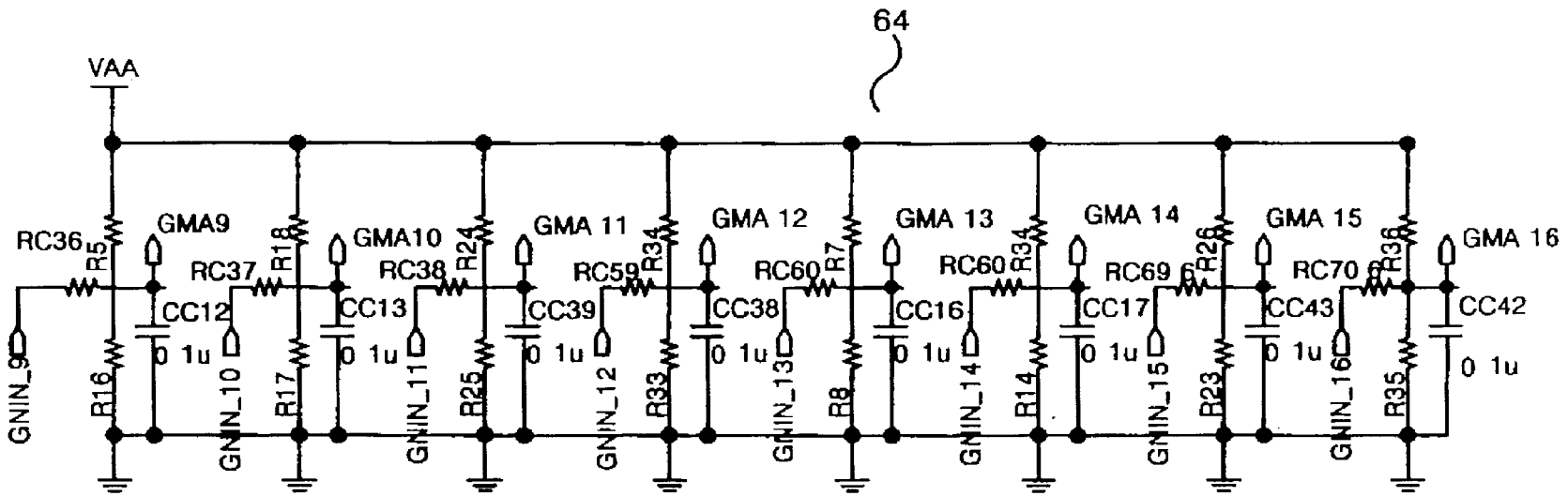

FIGS. 6A to 6D are exemplary circuit diagrams illustrating constructional details for two gamma voltage circuits with gamma voltage controllers according to one embodiment of the present invention. FIGS. 6A and 6B illustrate one programmable gamma voltage circuit and FIGS. 6C and 6D illustrate another. These two programmable gamma voltage circuits are utilized for providing respective first and second reference voltage signal groups (GMA1–GMA8 and GMA9–GMA16) in accordance with necessary positive/negative polarity requirements.

FIG. 6A shows a first programmable digital-to-analog converter (DAC) 61 for the first reference voltage signal group (GMA1–GMA8). The first programmable digital-to-analog converter 61 outputs 8 output voltage signals (GNIN_1-GNIN_8). The gamma voltage controller 62, shown in FIG. 6C, is connected to each output terminal of the first programmable digital-to-analog converter 61. Thus, the eight (8) output voltage signals from the DAC 61 (GNIN_1-GNIN_8), which are being output with uniform gap as discussed hereinbefore, are input to the gamma voltage controller 62 in FIG. 6C. The outputs of the gamma voltage controller 62 constitute the first reference voltage signal group (GMA1–GMA8) having a non-uniform gap between its two reference voltages. This non-uniform voltage gap between any two reference voltages may be set or adjusted (by setting or selecting appropriate resistance values for the resistors in the gamma voltage controller 62) depending on the T-V characteristics of a liquid crystal panel (e.g., the LCD panel 6 in FIG. 1) as shown in FIG. 7.

FIG. 6B shows a second programmable digital-to-analog converter 63 for the second reference voltage signal group (GMA9–GMA16). The second programmable digital-to-analog converter 63 outputs 8 output voltage signals (GNIN_9-GNIN_16). The gamma voltage controller 64, shown in FIG. 6D, is connected to the each output terminal of the second programmable digital-to-analog converter 63. Thus, the eight (8) output voltage signals from the DAC 63 (GNIN_9-GNIN_16), which are being output with uniform gap as discussed hereinbefore, are input to the second gamma voltage controller 64 in FIG. 6D. The outputs of the gamma voltage controller 64 constitute the second reference voltage signal group (GMA9–GMA16) having a non-uniform gap between its two reference voltages. As noted hereinbefore, this non-uniform voltage gap between any two reference voltages may be set or adjusted (by setting or selecting appropriate resistance values for the resistors in the gamma voltage controller 64) depending on the T-V characteristics of a liquid crystal panel (e.g., the LCD panel 6 in FIG. 1) as shown in FIG. 7

FIG. 7 shows the reference voltage signals output from the first and the second programmable gamma voltage circuits according to the values being set by the code 32. It can be seen from FIG. 7 that the voltage gap between two reference voltages for each 1 (one) bit change in the code 32 is non-uniform and can be closely adjusted according to the characteristics of the liquid crystal panel.

Thus, in a gamma voltage circuit according to the present invention, a non-uniform voltage difference between two reference voltage signals output by the gamma voltage circuit may be obtained through input digital control bits. Therefore, the gamma reference voltage signals can be precisely controlled according to the characteristics of the liquid crystal display panel. Hence, analog video signals that are closely aligned with a liquid crystal display panel can be provided as inputs to that liquid crystal panel.

The foregoing describes a liquid crystal display device with a gamma voltage controller according to the present invention. The gamma voltage controller includes a voltage-divider network of resistive elements and is part of a gamma voltage circuit, which also includes a programmable digital-to-analog converter. The output voltage signals from the programmable digital-to-analog converter are input to the gamma voltage controller. The voltage difference or gap between any two voltage signals output from the gamma voltage controller (i.e., the gamma reference voltage signals) can be finely aligned by setting appropriate values for different resistive elements in the gamma voltage controller. This allows generation of gamma reference voltage signals whose voltages can be precisely controlled according to the T-V characteristics of a liquid crystal display panel in the liquid crystal display device.

It will be apparent to those skilled in the art that various modifications and variations can be made in the liquid crystal display with a gamma voltage controller according to the present invention without departing from the spirit or scope of the invention. Thus, it is intended that the present invention cover the modifications and variations of this invention provided they come within he scope of the appended claims and their equivalents.

What is claimed is:

1. A gamma voltage circuit for a liquid crystal display comprising:

a programmable digital-to-analog converter (DAC) having a predetermined number of first set of outputs, wherein the programmable DAC is configured to output a first plurality of analog reference voltage signals in response to a corresponding plurality of digital control signals input thereto, wherein each of the first plurality of analog reference voltage signals appears on a corresponding one of the first set of outputs; and a gamma voltage controller connected to the first set of outputs to generate a second plurality of analog reference voltage signals by dividing the first plurality of analog reference voltage signals, wherein the gamma voltage controller includes a plurality of voltage divider networks with a second set of outputs, wherein each voltage divider network in the plurality of voltage divider networks has a first input and one of the second set of outputs, and wherein each the first input is connected to a corresponding one of the first set of outputs and each of the second set of outputs is connected to a column driver circuit for the liquid crystal display.

2. The gamma voltage circuit of claim 1, wherein each the voltage divider network includes:

a first resistive element with the first input and a third output, wherein the first resistive element is serially connected to the corresponding one of the first set of outputs via the first input; and a second resistive element connected to the third output and in parallel to the first resistive element, wherein an output of the second resistive element constitutes the one of the second set of outputs, and wherein a combination of the first and the second resistive elements divides a corresponding one of the first plurality of analog reference voltage signals appearing on the first input and generates a respective one of the second plurality of analog reference voltage signals on the one of the second set of outputs.

3. The gamma voltage circuit of claim 2, wherein the first resistive element is a first resistor, and wherein the second resistive element includes:

a second resistor; and a third resistor connected in series with the second resistor, wherein one end of the second resistor is connected to a power supply voltage and one end of the third resistor is connected to a circuit ground voltage, wherein the third output of the first resistor is connected to a junction of the second and third resistors, and wherein the one of the second set of outputs is taken out of the junction of the second and third resistors.

4. The gamma voltage controller of claim 3, wherein resistance of each of the first, second, and third resistors is individually adjustable.

5. A liquid crystal display (LCD) device comprising:

a liquid crystal display panel having a plurality of thin film transistors and a plurality of pixel electrodes, wherein each of the plurality of pixel electrodes is connected to a corresponding one of the plurality of thin film transistors;

a column driver for converting a video data signal into an analog video signal and applying the analog video signal to the plurality of pixel electrodes in the liquid crystal display panel;

a low driver for sequentially applying a scanning signal as a switching control signal to each of the plurality of thin film transistors in the liquid crystal display panel;

a controller for generating and outputting a first control signal for the column driver and a second control signal for the low driver; and a gamma voltage circuit connected to the column driver and supplying a plurality of reference voltage signals thereto, wherein the gamma voltage circuit includes:

a programmable digital-to-analog converter (DAC) having a predetermined number of first set of outputs, wherein the programmable DAC is configured to output a first plurality of analog reference voltage signals in response to a corresponding plurality of digital control signals input thereto, wherein each of the first plurality of analog reference voltage signals appears on a corresponding one of the first set of outputs, and a gamma voltage controller connected to the first set of outputs to generate a second plurality of analog reference voltage signals by dividing the first plurality of analog reference voltage signals, wherein the gamma voltage controller includes a plurality of voltage divider networks with a second set of outputs, wherein each voltage divider network in the plurality of voltage divider networks has a first input and one of the second set of outputs, and wherein each the first input is connected to a corresponding one of the first set of outputs and each of the second set of outputs is connected to the column driver.

6. The LCD device of claim 5, wherein each the voltage divider network in the gamma voltage controller includes:

a first resistive element with the first input and a third output, wherein the first resistive element is serially connected to the corresponding one of the first set of outputs via the first input; and a second resistive element connected to the third output and in parallel to the first resistive element, wherein an output of the second resistive element constitutes the one of the second set of outputs, and wherein a combination of the first and the second resistive elements divides a corresponding one of the first plurality of analog reference voltage signals appearing on the first input and generates a respective one of the second plurality of analog reference voltage signals on the one of the second set of outputs.

7. The LCD device of claim 6, wherein the first resistive element in each the voltage divider network is a first resistor, and wherein the second resistive element in each the voltage divider network includes:

a second resistor; and a third resistor connected in series with the second resistor, wherein one end of the second resistor is connected to a power supply voltage and one end of the third resistor is connected to a circuit ground voltage, wherein the third output of the first resistor is connected to a junction of the second and third resistors, and wherein the one of the second set of outputs is taken out of the junction of the second and third resistors.

8. The LCD device of claim 7, wherein resistance of each of the first, second, and third resistors in each the voltage divider network is individually adjustable.

* * * * *